US008963794B2

(12) United States Patent
Zhu et al.

(10) Patent No.: US 8,963,794 B2
(45) Date of Patent: Feb. 24, 2015

(54) DISTRIBUTED LOOP ANTENNAS

(75) Inventors: Jiang Zhu, Sunnyvale, CA (US); Jerzy Guterman, Mountain View, CA (US); Mattia Pascolini, San Mateo, CA (US); Jayesh Nath, Santa Clara, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 607 days.

(21) Appl. No.: 13/216,073

(22) Filed: Aug. 23, 2011

(65) Prior Publication Data

US 2013/0050050 A1 Feb. 28, 2013

(51) Int. Cl.

| | |
|---|---|
| ***H01Q 7/00*** | (2006.01) |
| ***H01Q 1/24*** | (2006.01) |
| ***H01Q 1/22*** | (2006.01) |
| ***H01Q 21/30*** | (2006.01) |

(52) U.S. Cl.

CPC ..... *H01Q 1/243* (2013.01); *H01Q 1/2283* (2013.01); *H01Q 1/2291* (2013.01); *H01Q 21/30* (2013.01)

USPC ..... 343/866; 343/702

(58) Field of Classification Search

USPC ..... 343/741, 866, 867, 702

See application file for complete search history.

(56) References Cited

U.S. PATENT DOCUMENTS

| | | | | |
|---|---|---|---|---|
| 2,600,179 | A * | 6/1952 | Alford | 343/767 |
| 4,323,900 | A * | 4/1982 | Krall et al. | 343/700 MS |
| 4,814,776 | A | 3/1989 | Caci et al. | |
| 5,225,846 | A * | 7/1993 | Koyama | 343/718 |
| 5,903,240 | A | 5/1999 | Kawahata et al. | |
| 6,429,818 | B1 | 8/2002 | Johnson et al. | |
| 6,784,843 | B2 | 8/2004 | Onaka et al. | |
| 7,205,942 | B2 | 4/2007 | Wang et al. | |
| 7,342,498 | B2 * | 3/2008 | Baba et al. | 340/572.5 |
| 7,701,395 | B2 | 4/2010 | Alvey et al. | |
| 7,830,320 | B2 | 11/2010 | Shamblin et al. | |
| 7,973,722 | B1 | 7/2011 | Hill et al. | |
| 7,982,616 | B2 | 7/2011 | Banerjee et al. | |
| 2004/0085245 | A1 | 5/2004 | Miyata et al. | |

(Continued)

FOREIGN PATENT DOCUMENTS

| | | |
|---|---|---|
| CN | 1520629 | 8/2004 |
| CN | 101432928 | 5/2009 |

(Continued)

OTHER PUBLICATIONS

Zhu et al., U.S. Appl. No. 13/216,012, filed Aug. 23, 2011.
Zhu et al., U.S. Appl. No. 13/299,123, filed Nov. 17, 2011.

*Primary Examiner* — Tan Ho

(74) *Attorney, Agent, or Firm* — Treyz Law Group; G. Victor Treyz; Michael H. Lyons

(57) ABSTRACT

Electronic devices may be provided with antenna structures such as distributed loop antenna resonating element structures. A distributed loop antenna may be formed on an elongated dielectric carrier and may have a longitudinal axis. The distributed loop antenna may include a loop antenna resonating element formed from a sheet of conductive material that extends around the longitudinal axis. A gap may be formed in the sheet of conductive material. The loop antenna resonating element may be directly fed or indirectly fed. In indirect feeding arrangements, an antenna feed structure for indirectly feeding the loop antenna resonating element may be formed from a directly fed loop antenna structure on the elongated dielectric carrier.

17 Claims, 20 Drawing Sheets

(56) References Cited

U.S. PATENT DOCUMENTS

| | | | | |
|---|---|---|---|---|
| 2005/0088363 | A1* | 4/2005 | Grossman et al. | 343/895 |
| 2009/0140946 | A1 | 6/2009 | Ziolkowski et al. | |
| 2009/0295672 | A1* | 12/2009 | Grossman et al. | 343/866 |
| 2010/0072287 | A1 | 3/2010 | Kai et al. | |
| 2010/0238072 | A1 | 9/2010 | Ayatollahi et al. | |

FOREIGN PATENT DOCUMENTS

| | | |
|---|---|---|
| EP | 1649546 | 4/2006 |
| EP | 2034555 | 1/2011 |
| WO | 02065583 | 8/2002 |
| WO | 2011076582 | 6/2011 |

* cited by examiner

| f | L1 | L2 |
|---|---|---|
| 2.4 GHz | WEAK RADIATION | STRONG RADIATION VIA COUPLING FROM L1 |
| 5 GHz | STRONG RADIATION | STRONG RADIATION VIA COUPLING FROM L1 |

FIG. 15

DISTRIBUTED LOOP ANTENNAS

BACKGROUND

This relates generally to electronic devices and, more particularly, to electronic devices with antennas.

Electronic devices such as computers are often provided with antennas. For example, a computer monitor with an integrated computer may be provided with antennas that are located along an edge of the monitor and are backed by antenna cavities.

Challenges can arise in mounting antennas within an electronic device. For example, the relative position between an antenna and surrounding device structures can have an impact on antenna tuning and bandwidth. If care is not taken, an antenna may become detuned or may exhibit an undesirably small efficiency bandwidth.

It would therefore be desirable to be able to provide improved antennas for use in electronic devices.

SUMMARY

Electronic devices may be provided with antenna structures. The antenna structures may include distributed loop antennas. A distributed loop antenna may have a distributed loop antenna resonating element structure with a longitudinal axis. The distributed loop antenna resonating element may be formed from a strip of metal having a first dimension that is wrapped around the longitudinal axis and a second dimension that is distributed along the longitudinal axis. A gap may be formed across the second dimension of the strip of metal. The gap may follow a meandering path to increase its capacitance. Additional components such as capacitors may bridge the gap. If desired, tunable components may be used to bridge the gap. The tunable components may include adjustable capacitors or other circuitry that may be adjusted by control circuitry to control antenna frequency response.

A distributed loop antenna may be formed on an elongated dielectric carrier that is aligned with the longitudinal axis of the distributed loop antenna resonating element structure. Part or all of the volume of the loop antenna may be buried inside the housing of the electronic device, leaving only a portion of the gap on the loop antenna exposed. The loop antenna resonating element structure may be directly fed or indirectly fed. In indirect feeding arrangements, an antenna feed structure for indirectly feeding the loop antenna resonating element may be formed from a directly fed loop antenna structure on the elongated dielectric carrier.

In electronic devices with multiple antennas, one or more antennas may be mounted in a device housing so that they lie along the longitudinal axis of a distributed loop antenna. This type of arrangement may help maximize isolation between antennas.

Further features of the invention, its nature and various advantages will be more apparent from the accompanying drawings and the following detailed description of the preferred embodiments.

BRIEF DESCRIPTION OF THE DRAWINGS

FIG. 15 is a table of antenna performance data for an illustrative indirectly fed distributed loop antenna showing respective contributions to performance that may be made by a loop-shaped indirect feeding structure and a distributed loop antenna resonating element structure in first and second communications bands of interest in accordance with the present invention.

DETAILED DESCRIPTION

Electronic devices may be provided with antennas and other wireless communications circuitry. The wireless communications circuitry may be used to support wireless communications in multiple wireless communications bands. One or more antennas may be provided in an electronic device. For example, antennas may be used to form an antenna array to support communications with a communications protocol such as the IEEE 802.11(n) protocol that uses multiple antennas.

Figure 1:
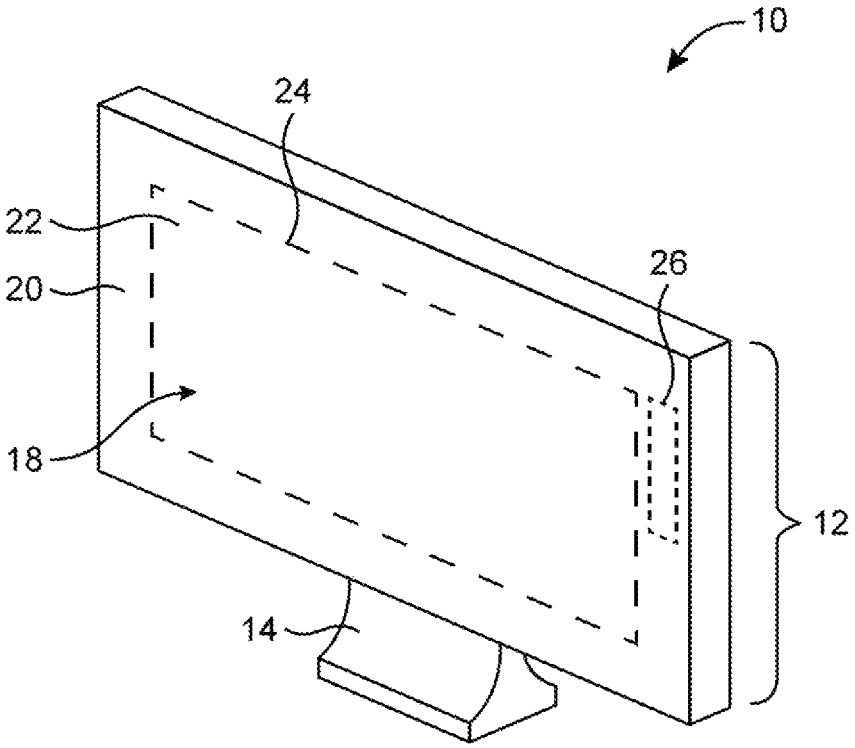
FIG. 1 is a perspective view of an illustrative electronic device with antenna structures in accordance with an embodiment of the present invention.

An illustrative electronic device of the type that may be provided with one or more antennas is shown in FIG. 1. Electronic device 10 may be a computer such as a computer that is integrated into a display such as a computer monitor. Electronic device 10 may also be a laptop computer, a tablet computer, a somewhat smaller portable device such as a wrist-watch device, pendant device, headphone device, earpiece device, or other wearable or miniature device, a cellular telephone, a media player, or other electronic equipment. Illustrative configurations in which electronic device 10 is a computer formed from a computer monitor are sometimes described herein as an example. In general, electronic device 10 may be any suitable electronic equipment.

Antennas may be formed in device 10 in any suitable location such as location 26. The antennas in device 10 may include loop antennas, inverted-F antennas, strip antennas, planar inverted-F antennas, slot antennas, cavity antennas, hybrid antennas that include antenna structures of more than one type, or other suitable antennas. The antennas may cover cellular network communications bands, wireless local area network communications bands (e.g., the 2.4 and 5 GHz bands associated with protocols such as the Bluetooth® and IEEE 802.11 protocols), and other communications bands. The antennas may support single band and/or multiband operation. For example, the antennas may be dual band antennas that cover the 2.4 and 5 GHz bands. The antennas may also cover more than two bands (e.g., by covering three or more bands or by covering four or more bands).

Conductive structures for the antennas may, if desired, be formed from conductive electronic device structures such as conductive housing structures, from conductive structures such as metal traces on plastic carriers, from metal traces in flexible printed circuits and rigid printed circuits, from metal foil supported by dielectric carrier structures, from wires, and from other conductive materials.

Device 10 may include a display such as display 18. Display 18 may be mounted in a housing such as electronic device housing 12. Housing 12 may be supported using a stand such as stand 14 or other support structure.

Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Display 18 may be a touch screen that incorporates capacitive touch electrodes or other touch sensor components or may be a display that is not touch sensitive. Display 18 may include image pixels formed from light-emitting diodes (LEDs), organic LEDs (OLEDs), plasma cells, electronic ink elements, liquid crystal display (LCD) components, or other suitable image pixel structures.

A cover glass layer may cover the surface of display 18. Rectangular active region 22 of display 18 may lie within rectangular boundary 24. Active region 22 may contain an array of image pixels that display images for a user. Active region 22 may be surrounded by an inactive peripheral region such as rectangular ring-shaped inactive region 20. The inactive portions of display 18 such as inactive region 20 are devoid of active image pixels. Display driver circuits, antennas (e.g., antennas in regions such as region 26), and other components that do not generate images may be located under inactive region 20.

The cover glass for display 18 may cover both active region 22 and inactive region 20. The inner surface of the cover glass in inactive region 20 may be coated with a layer of an opaque masking material such as opaque plastic (e.g., a dark polyester film) or black ink. The opaque masking layer may help hide internal components in device 10 such as antennas, driver circuits, housing structures, mounting structures, and other structures from view.

The cover layer for display 18, which is sometimes referred to as a cover glass, may be formed from a dielectric such as glass or plastic. Antennas mounted in region 26 under an inactive portion of the cover glass may transmit and receive signals through the cover glass. This allows the antennas to operate, even when some or all of the structures in housing 12 are formed from conductive materials. For example, mounting the antenna structures of device 10 in region 26 under part of inactive region 20 may allow the antennas to operate even in arrangements in which some or all of the walls of housing 12 are formed from a metal such as aluminum or stainless steel (as examples).

Figure 2:
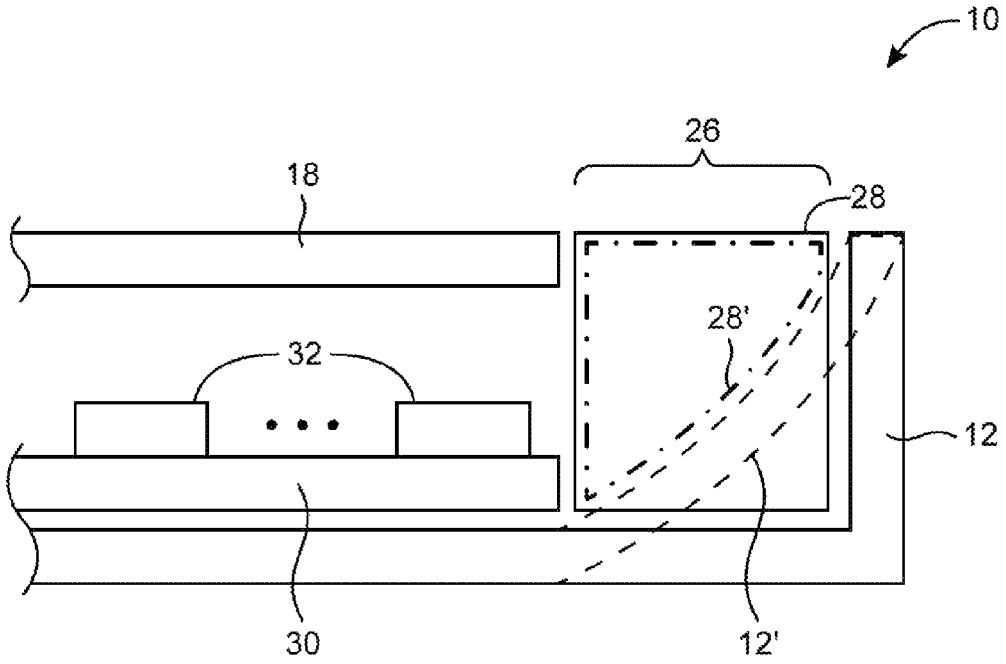
FIG. 2 is a cross-sectional side view of illustrative antenna structures mounted within an illustrative electronic device in accordance with an embodiment of the present invention.

A cross-sectional side view of an illustrative antenna mounted in an electronic device such as device 10 of FIG. 1 is shown in FIG. 2. As shown in FIG. 2, display 18 may be mounted within housing 12. Housing 12 may have peripheral sidewalls that are perpendicular to the planar rear surface of housing 12 or may have sidewalls that are curved, as shown by dashed line 12'. Electrical components 32 may be mounted on one or more substrates such as substrate 30 within the interior of housing 12. Electrical components 32 may include integrated circuits, discrete components such as resistors, capacitors, and inductors, connectors, sensors, audio components such as microphones and speakers, and other electronic equipment. Substrate 30 may be a plastic substrate, a rigid printed circuit board (e.g., a circuit board formed from fiberglass-filled epoxy such as an FR4 printed circuit board), a flexible printed circuit board ("flex circuit") formed from a flexible sheet of polyimide or other flexible polymer, or other suitable support structure.

One or more antennas such as antenna 28 may be mounted within housing 12. As shown in FIG. 2, antenna 28 may have a shape that allows antenna 28 to fit within the confines of housing 12 under regions such as region 26 (e.g., under an exterior surface of device 10 and housing 12 that is associated with inactive peripheral region 20 of display 18). In this type of configuration, housing 12 may have conductive walls or other conductive structures that at least partly define an interior region in which antenna 28 is mounted. A top surface of antenna 28 may lie within the exterior surface of housing 12 and device 10 while the remainder of antenna 28 is buried within the interior region of housing 12 and device 10 that is defined by housing walls 12 or 12'.

Other suitable mounting locations in device 10 include positions behind dielectric antenna windows, etc. In configurations in which device 10 uses a curved housing sidewall shape such as sidewall shape 12', the shape of antenna 28 may be adjusted accordingly (e.g., so that the antenna has a cross-sectional outline that lies within line 28'). In general, antenna 28 may have any suitable cross-sectional shape. The illustrative shapes of outlines 28 and 28' in FIG. 2 are merely illustrative.

Figure 3:
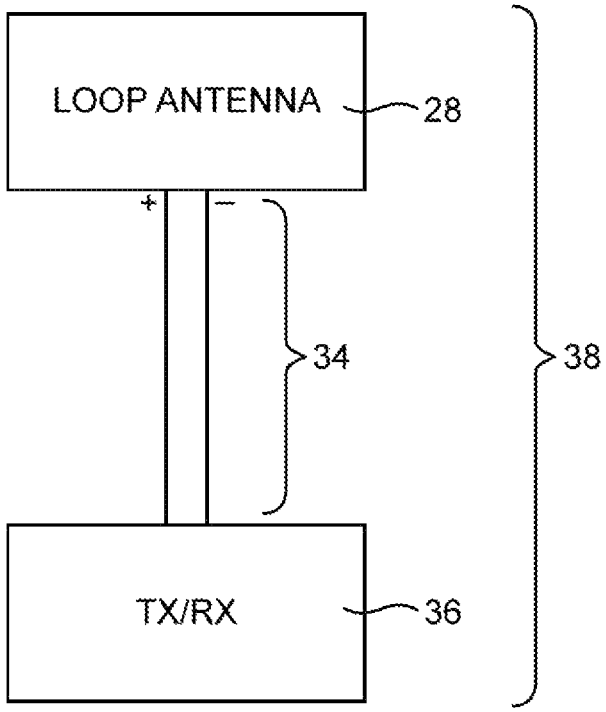
FIG. 3 is a diagram of illustrative wireless circuitry for an electronic device including a transceiver circuit and antenna coupled by a transmission line path in accordance with an embodiment of the present invention.

As shown in FIG. 3, wireless circuitry 38 for electronic device 10 may include radio-frequency transceiver circuitry 36 (e.g., one or more receivers, one or more transmitters, etc.). One or more antennas such as antenna 28 may be used in device 10. Each antenna 28 may be coupled to transceiver circuitry 36 using a radio-frequency communications path such as transmission line 34. Transmission line 34 may include one or more portions of transmission lines such as coaxial cable transmission lines, microstrip transmission lines, stripline transmission lines, edge coupled microstrip transmission lines, edge coupled stripline transmission lines, or other suitable transmission line structures. Transmission line 34 may include one or more portions of different types of transmission line structures (e.g., a segment of coaxial cable, a segment of a microstrip transmission line formed on a printed circuit board, etc.). Transmission line 34 may contain a positive conductor (+) and a ground conductor (−). The conductors in transmission line may be formed from wires, braided wires, strips of metal, conductive traces on substrates, planar metal structures, housing structures, or other conductive structures.

Loop antenna 28 may be formed using conductive antenna resonating element structures such as metal traces on a dielectric carrier such as a plastic support structure. If desired, the conductive structures that form loop antenna 28 may include wires, metal foil, conductive traces on printed circuit boards, portions of conductive housing structures such as conductive housing walls and conductive internal frame structures, and other conductive structures.

Figure 4:
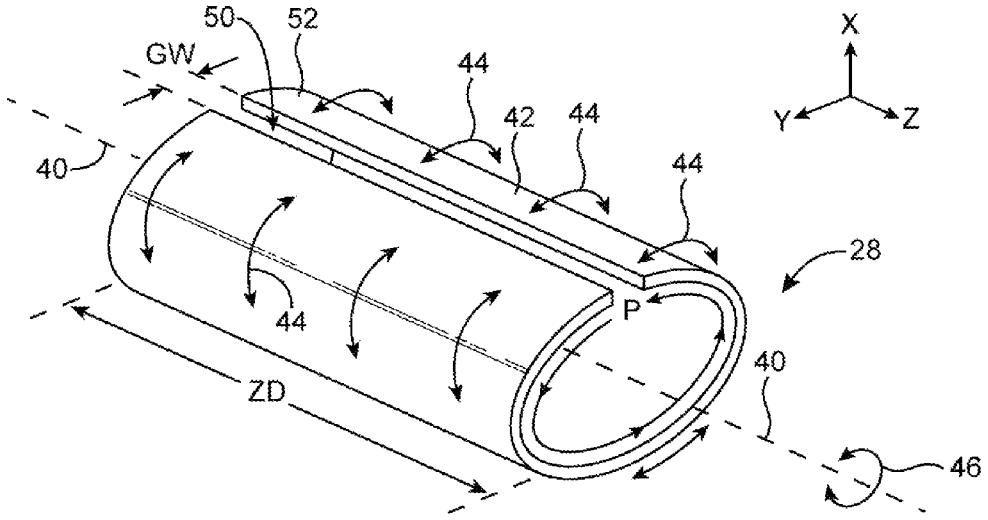
FIG. 4 is a perspective view of conductive structures forming an illustrative antenna resonating element for a distributed loop antenna in accordance with an embodiment of the present invention.

Loop antenna 28 may have conductive structures that are spread out ("distributed") along the longitudinal axis of the loop. Loop antenna 28 may therefore sometimes be referred to as a distributed loop antenna. As shown in FIG. 4, loop antenna 38 may have a longitudinal axis such as axis 40. Antenna 28 may be formed from an antenna resonating element structure that contains conductive structures 52. Conductive structures 52 may include a sheet of conductor that has a first dimension that is wrapped around longitudinal axis 40 and a second dimension ZD that extends along the length of longitudinal axis 40.

Conductive structures 50 may wrap around axis 40 following rotational directions 46. During operation, antenna currents can flow within sheet 52 around axis 40. In effect, sheet 52 forms a wide strip of conductor in the shape of a loop that is characterized by a perimeter P. The antenna currents flowing in sheet 52 tend to lie in planes parallel to the X-Y plane of FIG. 4, as indicated by arrows 44. As a result, the "loop" of loop antenna 28 effectively lies in the X-Y plane, whereas the longitudinal axis 40 that runs along the center of the wrapped conductive sheet (sheet 52) lies parallel to the Z-axis (and perpendicular to the X-Y plane of the antenna loop).

It may be desirable to form antenna 28 from conductive structures that exhibit a relatively small dimension P. In a loop without any break along periphery P, the antenna may resonate at signal frequencies where the signal has a wavelength approximately equal to P. In compact structures with unbroken loop shapes, the frequency of the communications band covered by antenna 28 may therefore tend to be high. By incorporating a gap or other structure into the loop, a capacitance can be introduced into antenna 28. With the presence of a capacitance within the loop antenna, the resonant frequency of the antenna may be reduced to a desired frequency of operation.

Any suitable structure may be used to interpose a capacitance within the loop of conductor formed by conductive sheet 52. For example, one or more gaps such as gap 50 may be formed. Gap 50 may be filled with dielectric (e.g., a solid dielectric such as plastic, etc. or a dielectric such as air). The gap width GW of gap 50 may affect the value of the capacitance formed by gap 50 (e.g., the capacitance of the gap may tend to increase as gap width GW is decreased).

Conductive sheet 52 may be formed by metal traces on a dielectric carrier, metal on a wrapped flex circuit, metal foil that has been bent into a desired shape, and other suitable conductive structures. In the example of FIG. 4, metal sheet 52 has a constant dimension ZD as sheet 52 wraps around axis 40. If desired, metal layer 52 may have a dimension ZD parallel to longitudinal antenna axis 40 that varies as a function of position around axis 40 (i.e., ZD need not be constant at all portions of the loop antenna). The FIG. 4 arrangement is merely illustrative.

Figure 5:
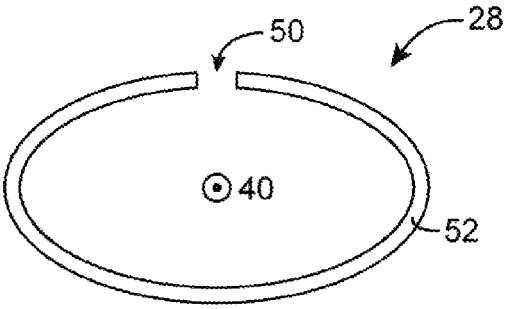
FIG. 5 is a cross-sectional end view of an illustrative distributed loop antenna having an oval cross-sectional shape in accordance with an embodiment of the present invention.
Figure 6:
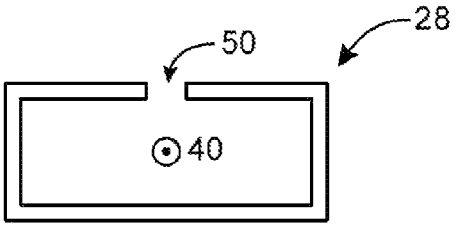
FIG. 6 is a cross-sectional end view of an illustrative distributed loop antenna having a rectangular cross-sectional shape in accordance with an embodiment of the present invention.
Figure 7:
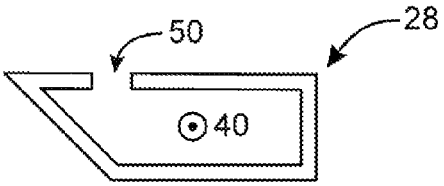
FIG. 7 is a cross-sectional end view of an illustrative distributed loop antenna having a cross-sectional shape with an angled side in accordance with an embodiment of the present invention.
Figure 8:
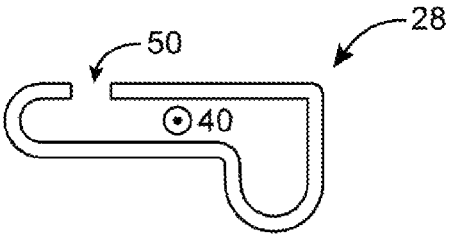
FIG. 8 is a cross-sectional end view of an illustrative distributed loop antenna having a cross-sectional shape with a combination of straight and curved sides in accordance with an embodiment of the present invention.

Distributed loop antenna 28 may have any suitable cross-sectional shape that forms a loop of antenna currents around axis 40. As shown in FIG. 5, for example, conductive layer 52 may have an oval cross-sectional shape when viewed along longitudinal axis 40. In the FIG. 6 example, conductive layer 52 of distributed loop antenna 28 has a rectangular cross-sectional shape. In the example of FIG. 7, conductive layer 52 forms a rectangular cross-sectional shape for antenna 28 with an angled sidewall. In particular, the upper and lower surfaces of antenna 28 of FIG. 7 are parallel to each other and are perpendicular to the right surface of antenna 28. The left surface of antenna 28 is angled at a non-orthogonal angle with respect to the upper and lower surfaces and does not lie parallel to the right surface of antenna 28. If desired, some of the surfaces of antenna 28 may be planar and other surfaces of antenna 28 may be non-planar, so that the cross-sectional shape of antenna 28 when viewed along longitudinal axis 40 has a combination of straight and curved sides, as shown in FIG. 8. Part or all of antenna's volume may be buried inside the housing of the electronic device, as shown in FIG. 2, leaving only gap 50 exposed. For example, structures of the type shown in FIGS. 5, 6, 7, and 8 may be located where shown by structures 28 of FIG. 2, with gap 50 (i.e., a gap on top surface TS of FIG. 17*a*) located in the opening under region 26 that is formed between display 18 and housing wall 12 or other openings within device 10. The examples of FIGS. 5, 6, 7, and 8 are merely illustrative. In general, conductive structures 52 may have any suitable shape that causes antenna currents to flow around axis 40.

Figure 9:
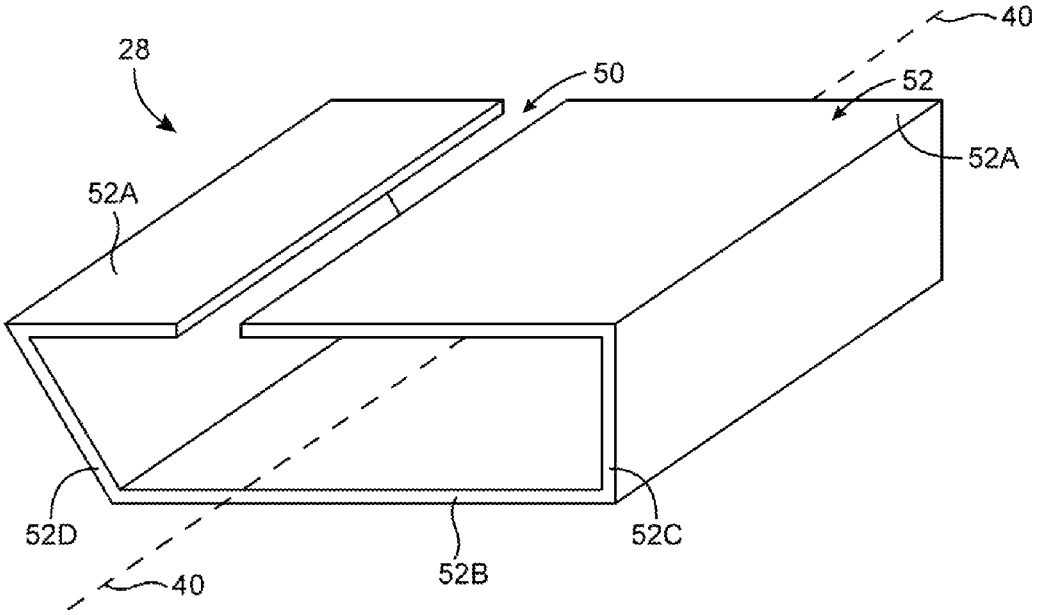
FIG. 9 is a perspective view of conductive structures forming an illustrative antenna resonating element for a distributed loop antenna with at least one angled surface in accordance with an embodiment of the present invention.

FIG. 9 is a perspective view of an illustrative shape that may be used for conductive structures 52 of distributed loop antenna 28. As shown in FIG. 9, conductive structures 52 may have a planar upper portion such as planar upper portion 52A. Longitudinal gap 50 may run across dimension ZD, parallel to longitudinal distributed loop antenna axis 40 (i.e., gap 50 may span the strip of conductor forming conductive structures 52). Conductive structure 52 may also have a planar lower portion such as planar lower portion 52B. Planar side portion 52C may lie in a plane that is perpendicular to the planes of upper planar member 52A and lower planar member 52B. Planar side portion 52D may lie in a plane that is oriented with a non-zero angle with respect to the plane of planar side portion 52C and may lie in a plane that is not orthogonal to the planes containing upper layer 52A and lower layer 52B. Although shown as being planar in the example of FIG. 9, structures 52A, 52B, 52C, and 52D may, if desired, contain curves or bends. Different number of surfaces and surfaces with different orientations may also be used in forming conductive structures 52. The FIG. 9 configuration is merely illustrative.

Figure 10:
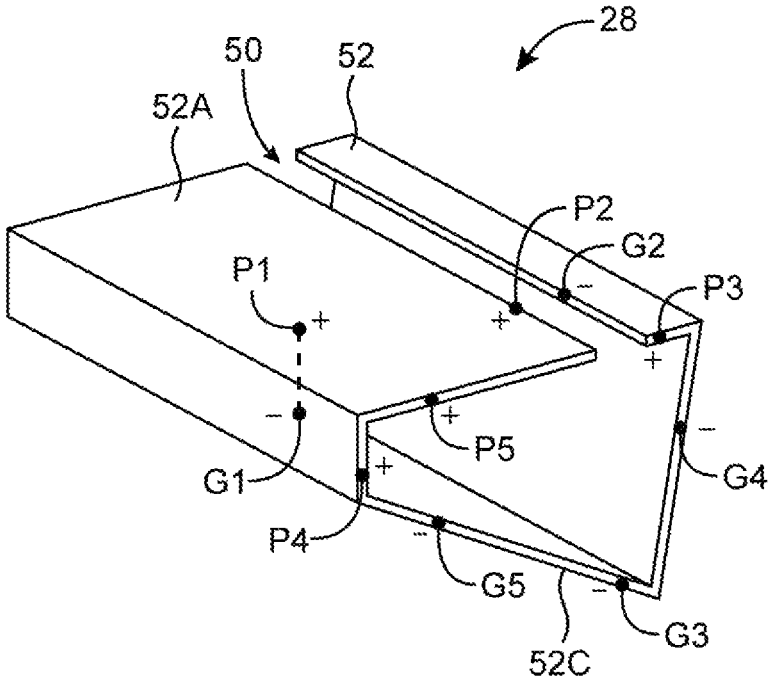
FIG. 10 is a perspective view of illustrative distributed loop antenna structures showing illustrative locations that may be used for antenna feed terminals that directly feed a distributed loop antenna in accordance with an embodiment of the present invention.

If desired, antenna 28 may be directly fed. For example, the positive and ground conductors of transmission line 34 (FIG. 3) may be coupled respectively to a positive antenna feed terminal and a ground antenna feed terminal on distributed loop antenna 28. Illustrative feed terminal locations for the antenna feed on distributed loop antenna 28 are shown in FIG. 10. A shown in FIG. 10, antenna 28 may be fed using an antenna feed that includes positive antenna feed terminal P1 on upper antenna surface 52A and ground antenna feed terminal P2 on lower antenna surface 52C (which is not parallel to upper surface 52A in the FIG. 10 example). Distributed loop antenna 28 of FIG. 10 may also be fed using an antenna feed formed from positive antenna feed terminal P2 and ground antenna feed terminal G2. Another possible feed location is associated with positive antenna feed terminal P3 and ground antenna feed terminal P4. Positive antenna feed terminal P5 and corresponding ground antenna feed terminal G5 may also be used in forming an antenna feed for distributed loop antenna 28. If desired, matching network elements formed from discrete electrical components and/or conductive structures such as metal structures may be used in forming an antenna feed arrangement for distributed loop antenna 28. The illustrative antenna feed locations of FIG. 10 are merely illustrative.

Another way in which to feed distributed loop antenna 28 involves near field electromagnetic coupling. This type of arrangement, which may be referred to as an indirect feed arrangement involves the use of first antenna structure to indirectly feed a second antenna structure. Transmission line 34 may be used to directly feed the first structure (sometimes referred to as an antenna feed structure). Near-field electromagnetic coupling may be used to transfer radio-frequency signals from the antenna feed structure to a second antenna structure (sometimes referred to as an antenna resonating element structure).

During signal transmission, radio-frequency signals from a transmitter circuit are directly feed to the feed structure and are electromagnetically coupled to the antenna resonating element structure. The antenna resonating element structure radiates the coupled signals. During signal reception, radio-frequency signals that are received by the antenna resonating element structure are coupled to the nearby antenna feed structure and, using the transmission line, are routed to a receiver circuit. In some configurations, the antenna feed structure may contribute to antenna performance (e.g., the antenna feed structure may form part of the radiating/receiving structures at certain frequencies of operation).

The antenna feed structure and antenna resonating element structure may have any suitable orientation with respect to each other. With one suitable arrangement, which is described in connection with the examples of FIGS. 11, 12, and 13, the antenna feed structure is formed from a directly fed loop antenna structure (antenna structure L1) and the antenna resonating element structure is formed from a distributed loop antenna structure (antenna structure L2). Directly fed loop antenna structure L1 may include a loop of conductive material 56 that is directly fed by transmission line 34. The positive conductor in transmission line 34 may be connected to positive antenna feed terminal (+) and the ground conductor in transmission line 34 may be connected to ground antenna feed terminal (−). Distributed loop antenna L2 may be formed using conductive structures such as conductive structures 52 that are distributed along the length of longitudinal axis 40. To avoid over-complicating the drawings, the "distributed" shape of conductive structures 52 in antenna resonating element L2 is not depicted in FIGS. 11, 12, and 13. Electromagnetic fields that may be coupled between structures L1 and L2 during operation are represented by lines 54.

Figure 11:
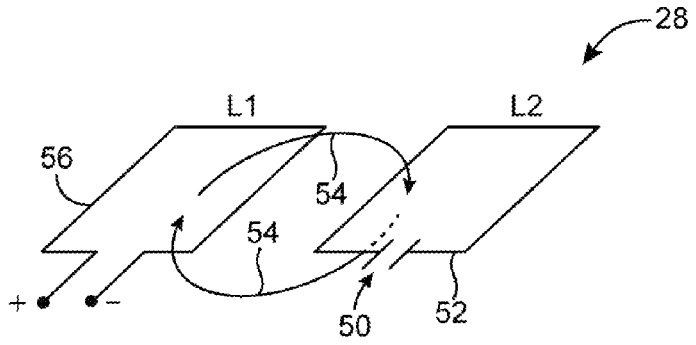
FIG. 11 is a diagram showing how a first loop antenna structure that is directly fed may serve as an indirect feeding structure for indirectly feeding a second loop antenna structure through near field electromagnetic coupling in a configuration in which the first loop antenna structure is coplanar with the second loop antenna structure in accordance with an embodiment of the present invention.
Figure 12:
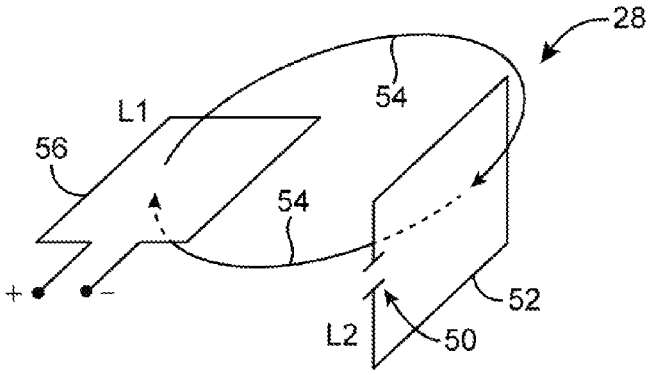
FIG. 12 is a diagram showing how a first loop antenna structure that is directly fed may serve as an indirect feeding structure for indirectly feeding a second loop antenna structure through near field electromagnetic coupling in a configuration in which the first loop antenna structure lies in a plane that is perpendicular to the plane of the second loop antenna structure in accordance with an embodiment of the present invention.
Figure 13:
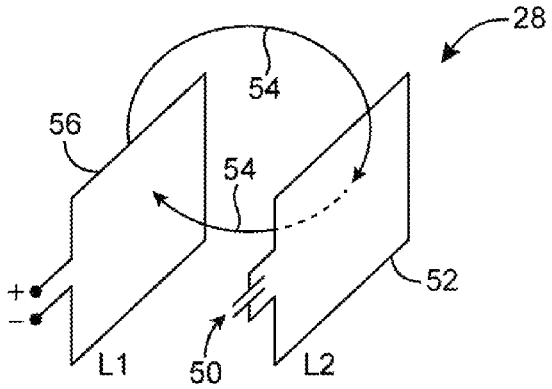
FIG. 13 is a diagram showing how a first loop antenna structure that is directly fed may serve as an indirect feeding structure for indirectly feeding a second loop antenna structure through near field electromagnetic coupling in a configuration in which the first loop antenna structure and the second loop antenna structure lie in distinct parallel planes in accordance with an embodiment of the present invention.

In configurations of the type shown in FIG. 11, directly fed antenna structure L1 and indirectly feed antenna structure L2 lie within a common plane. In configurations of the type shown in FIG. 12, the plane that contains antenna feed structure L1 lies perpendicular to the plane that contains antenna resonating element structure L2. FIG. 13 shows another illustrative configuration that may be used for antenna 28. In the FIG. 13 arrangement, antenna feed structure L1 and antenna resonating element structure L2 are formed from loops that lie in distinct parallel planes.

The relative contribution of directly fed antenna structure L1 and indirectly fed antenna resonating element structure to the overall performance of distributed loop antenna 28 depends on the frequency of operation of antenna 28, the relative positions of structures L1 and L2, and the shape of structures L1 and L2.

Figure 14:
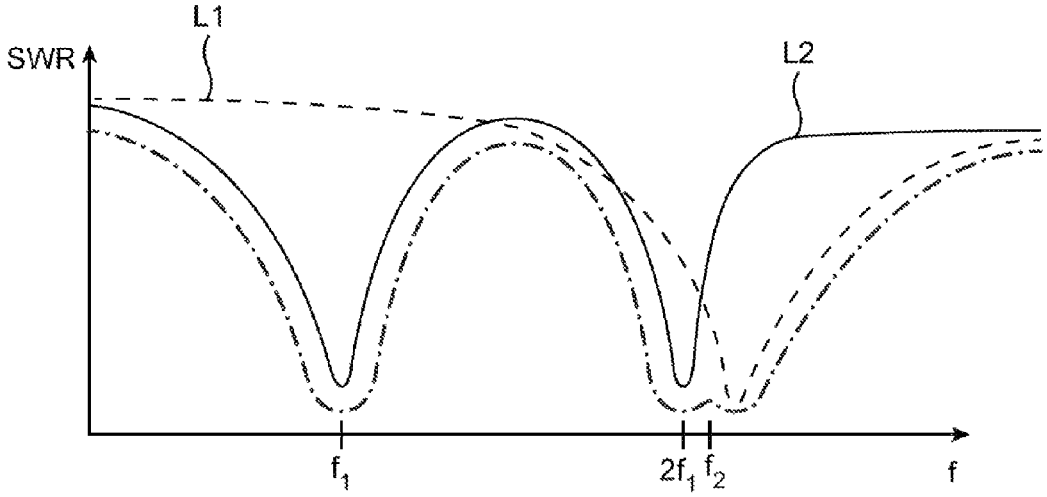
FIG. 14 is a graph of antenna performance for an illustrative indirectly fed distributed loop antenna showing respective contributions to performance that may be made by a loop-shaped indirect feeding structure and a distributed loop antenna resonating element structure in accordance with the present invention.

A graph corresponding to an illustrative antenna 28 in which both structures L1 and L2 contribute to antenna performance (for at least some frequencies of operation) is shown in FIG. 14. In FIG. 14, standing wave ratio (SWR) for a distributed loop antenna that includes both antenna structure L1 and antenna structure L2 (e.g., in an arrangement of the type shown in FIG. 12) is plotted as a function of operating frequency f. Frequency f1 may correspond to the center frequency of a first band of interest such as an IEEE 802.11 band of 2.4 GHz (as an example). Frequency f2 may correspond to the center frequency of a second band of interest such as an IEEE 802.11 band of 5 GHz (as an example). Antennas that cover more than two bands, fewer than two bands, and/or other bands of interest may use a distributed loop configuration. The example of FIG. 14 is merely illustrative.

Curve L2 of FIG. 14 corresponds to the contribution to antenna 28 from antenna resonating element L2. As shown in FIG. 14, there are performance contributions from L2 at frequency f1 and a frequency that is equal to about 2 times f1 (i.e., at 2f1, which is the second harmonic of frequency f1). The antenna performance contribution from antenna structure L2 at the second harmonic of frequency f1 may lie close to upper band center frequency f2.

Curve L1 corresponds to the contribution to antenna 28 from antenna resonating element L1. There may be relatively little contribution to antenna performance from L1 at frequencies in the vicinity of low band frequency f1. However, at frequencies in the vicinity of f2, L1 may exhibit a resonance that broadens the bandwidth of antenna 28 from L2 and helps antenna 28 adequately cover the upper band at f2.

A table illustrating directly fed structure L1 and indirectly fed structure L2 may contribute to the performance of distributed loop antenna 28 that incorporates structures L1 and L2. At a first frequency (e.g., frequency f1 of FIG. 14 such as 2.4 GHz), directly fed structure L1 may not contribute significantly to the resonant behavior of antenna 28, as indicated by the entry "weak radiation" in the table of FIG. 15. As indicated by the entry "strong radiation," however, structure L1 may contribute significantly to antenna performance at a second frequency (e.g., frequency f2 of FIG. 14 such as 5 GHz). The performance of structure L2 due to coupling from structure L1 may be strong at 2.4 GHz and at 5 GHz, as indicated by the entries in the right-hand row of the table of FIG. 15.

Figure 16A:
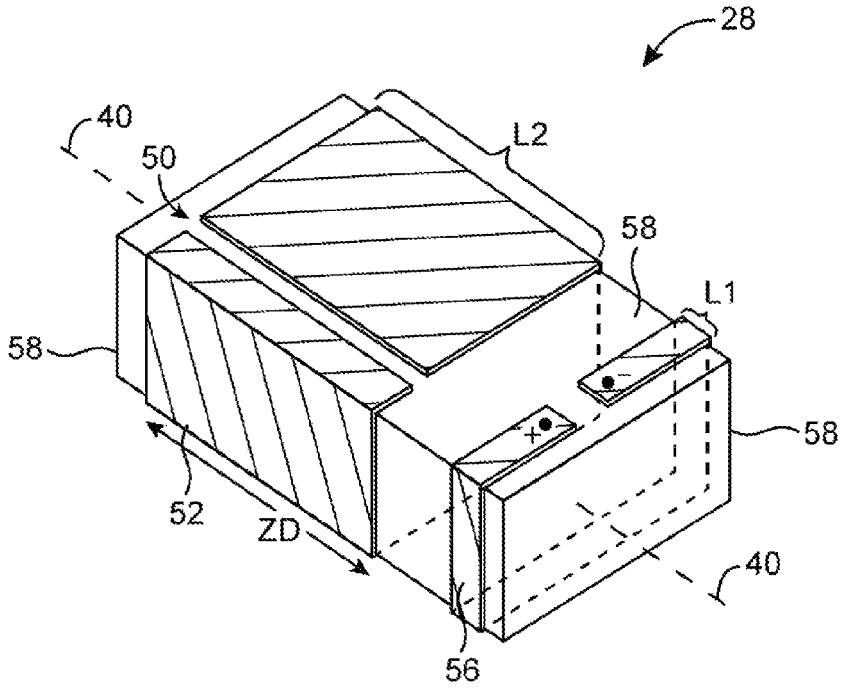
FIG. 16*a* is a perspective view of an illustrative indirectly fed distributed loop antenna in which a feeding loop structure and a distributed loop antenna structure are mounted parallel to each other without lying in a common plane in accordance with an embodiment of the present invention.

FIG. 16*a* is a perspective view of an illustrative configuration that may be used for distributed loop antenna 28. Distributed loop antenna 28 has a first portion formed from antenna resonating element structure L2 and a second portion formed from antenna feed structure L1. Feed structure L1 may be a loop antenna structure that is directly fed by transmission line 34 at a positive antenna feed terminal (+) and ground antenna feed terminal (−). Antenna resonating element structure L2 may be a distributed loop antenna structure having a dimension ZD along longitudinal axis 40 (i.e., the conductor of the loop in antenna resonating element structure L2 may be axially distributed). Conductive loop structure 56 of antenna feed structure L1 may be located in a longitudinally offset plane that lies parallel to the plane containing the loop of structure L2, as described in connection with FIG. 13.

Figure 16B:
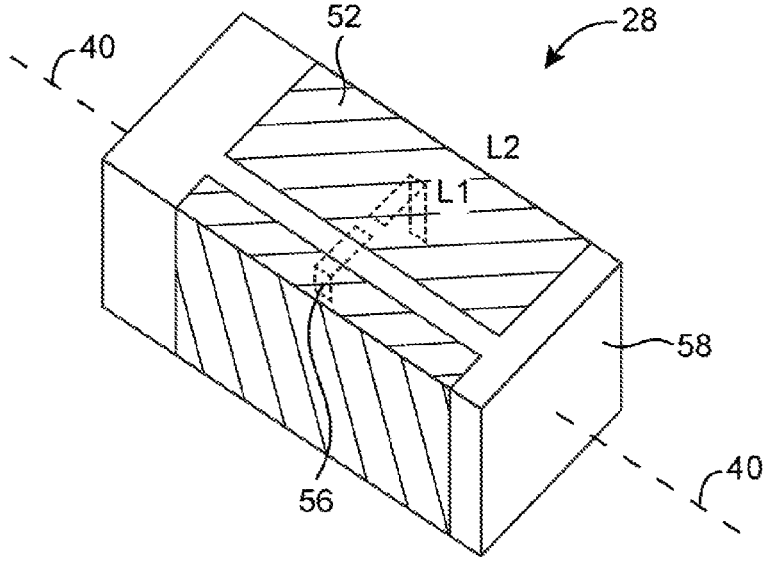
FIG. 16*b* is a perspective view of an illustrative indirectly fed distributed loop antenna in which a feeding loop structure and a distributed loop antenna structure are mounted parallel to one another within a common plane with the feeding loop nested within the distributed loop antenna structure in accordance with an embodiment of the present invention.

If desired, the structures of antenna 28 may be configured so that the loops of structures L1 and L2 are coplanar. As shown in FIG. 16*b*, for example, indirectly fed distributed loop antenna 28 may have a feeding loop structure L1 and a distributed loop antenna structure L2 that are mounted parallel to one another within a common plane. In a configuration of the type shown in FIG. 16*b*, the feeding loop L1 may be nested within the distributed loop antenna structure L2.

Conductive structures 52 and 56 may be formed from metal, conductive materials that contain metal, or other conductive substances. One or more support structures such as support structures 58 may be used to support conductive structures 52 and 56 of antenna structures L1 and L2 in distributed loop antenna 28. Support structures 58 may be formed from a dielectric such as plastic. Conductive structures 52 may be, for example, metal traces formed on a plastic carrier or metal traces formed on a flex circuit substrate or other substrate that is attached to support structures 58 (as examples).

Figure 17A:
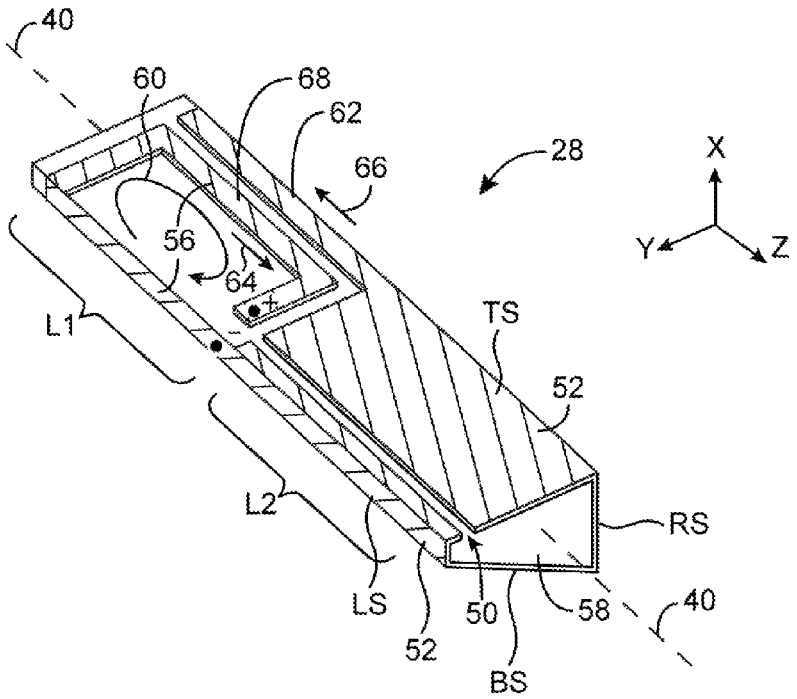
FIG. 17*a* is a perspective view of an illustrative indirectly fed distributed loop antenna in which a feeding loop structure and a distributed loop antenna structure are oriented perpendicular to each other in accordance with an embodiment of the present invention.

In the illustrative configuration for distributed loop antenna 28 that is shown in FIG. 17*a*, support structures 58 have parallel left and right surfaces LS and RS and have a bottom surface BS that is angled with respect to top surface TS. Directly fed antenna feed structure L1 may be directly fed by transmission line 34 using an antenna feed formed a positive antenna feed terminal (+) and a ground antenna feed terminal (−). During operation, currents in structure L1 may circulate within structure L1 as indicated by loop 60.

Indirectly fed antenna resonating element structure L2, which is indirectly fed by structure L1, may be formed from conductive structures 52 that are wrapped around longitudinal axis 40 of antenna 28. Gap 50 or other suitable structures or components that are interposed in the loop of structure L2 may be used to create a capacitance within the loop of structure L2 (as an example).

As shown in FIG. 17*a*, some of the conductive structures of antenna structures L1 and L2 may be electrically coupled to each other. For example, some of the metal structures on surfaces LS, RS, and BS (sometimes referred to as ground plane structures) may extend into parts of structure L1 and parts of structure L2.

Figure 17B:
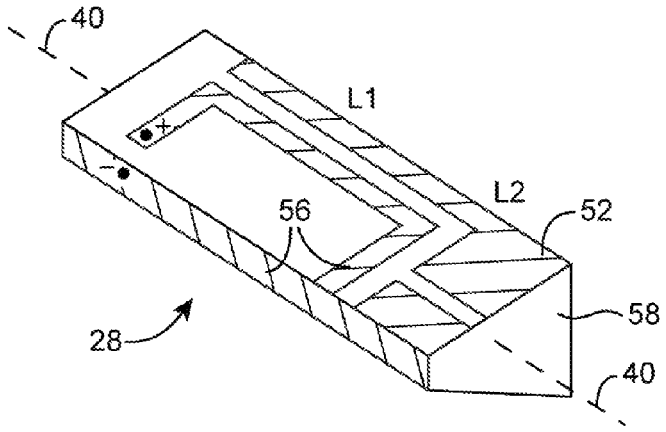
FIG. 17*b* is a perspective view of an illustrative indirectly fed distributed loop antenna of the type shown in FIG. 17*a* in which the feed for the feeding loop structure is not immediately adjacent to the distributed loop antenna structure in accordance with an embodiment of the present invention.

In the example of FIG. 17*a*, the feed for structure L1 that is formed from terminals (+) and (−) is located adjacent to structure L2. In the illustrative configuration for distributed loop antenna 28 that is shown in FIG. 17*b*, the feed for the feeding loop structure is not immediately adjacent to the distributed loop antenna structure in accordance with an embodiment of the present invention. These are merely illustrative feed locations for structure L1. Any suitable feeding arrangement may be used if desired.

The coupling between structures L1 and L2 is affected both by electromagnetic near field coupling and by electrical coupling through shared conductive structures. Electromagnetic coupling occurs when electromagnetic fields such as fields 54 of FIGS. 11, 12, and 13 that are generated by one loop pass through the other loop. Electric coupling occurs when current is generated in a shared conductor such as a portion of a shared ground plane structure. Consider, as an example, current flowing in portion 68 of loop L1 in direction 64. This current may electromagnetically induce a current in direction 66 in structures 62. Because structure 62 is electrically connected to structures 52 (because structure 62 is a longitudinal extension of structures 52), the flow of induced current 66 tends to result in currents in structures 52. The presence of portion 62 in antenna 28 may therefore enhance coupling between antenna structures L1 and L2.

Figure 18:
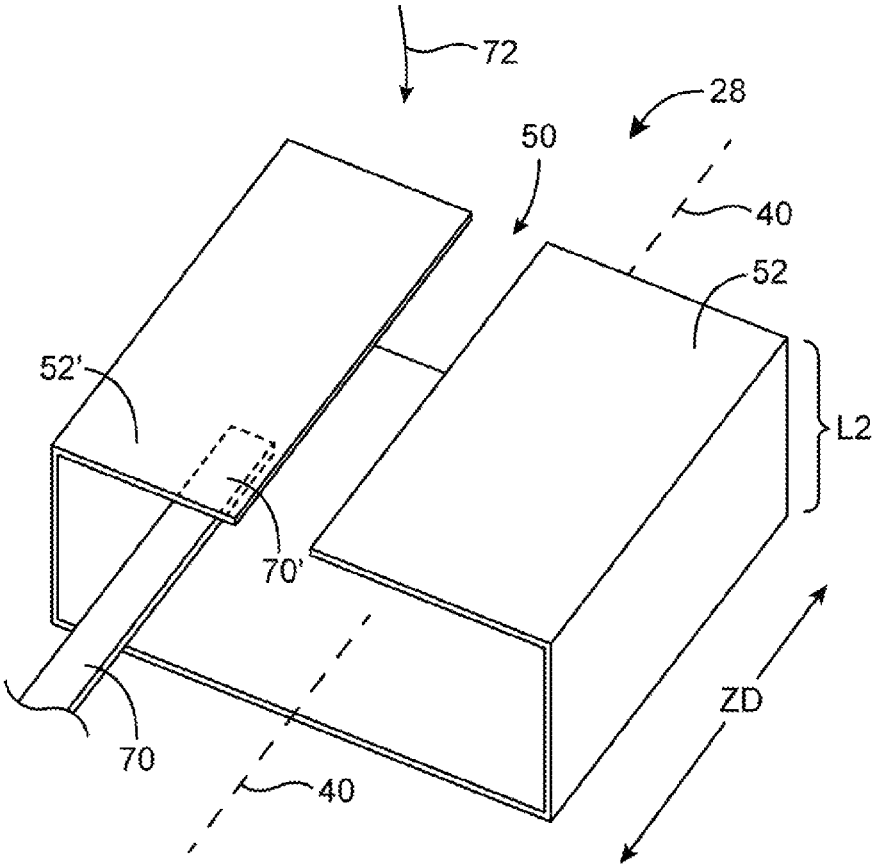
FIG. 18 is a perspective view of an illustrative indirectly fed distributed loop antenna in which the feeding structure includes a strip of conductor that overlaps part of a distributed loop antenna resonating element surface in accordance with an embodiment of the present invention.

Another illustrative indirect feeding arrangement that may be used for antenna 28 is shown in FIG. 18. Conductive structures 52 may be distributed along longitudinal axis 40 in distributed loop antenna resonating element structure L2. In the example of FIG. 18, conductive strip 70 may have a portion such as portion 70 that overlaps with portion 52' of conductive structures 52. Portion 70' may be a portion of a metal strip that is separated by air, plastic, or other dielectric from the metal of structures 52'. Through near-field electromagnetic coupling, radio-frequency signals on portion 70' and radio-frequency signals in portion 52' may be coupled to each other.

Figure 19:
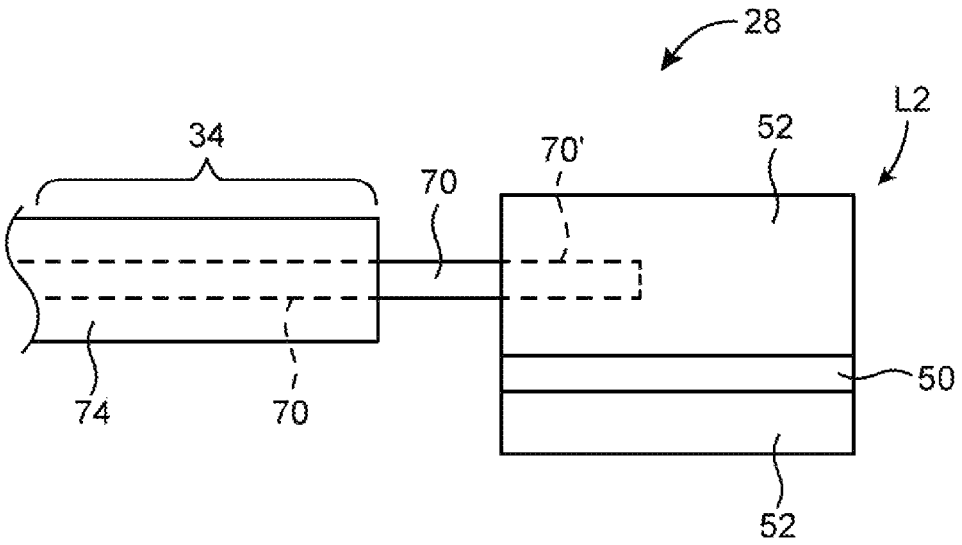
FIG. 19 is a top view of an illustrative indirectly fed distributed loop antenna of the type shown in FIG. 18 showing how the strip of conductor for forming an indirect feed may be an extension from part of a transmission line structure in accordance with an embodiment of the present invention.

A top view of the antenna structures 28 taken in direction 72 of FIG. 18 is shown in FIG. 19. As shown in FIG. 19, transmission line 34 may have a positive conductor formed from metal strip 70 and a ground structure formed from metal strip 74. Metal strip 74 and metal strip 70 may be separated by a dielectric layer (e.g., in a printed circuit substrate or other suitable substrate) and may form a microstrip transmission line (as an example). Extension 70' of strip 70 may protrude under structures 52 in distributed loop antenna resonating element L2, to create an arrangement that allows for near field coupling.

Figure 20:
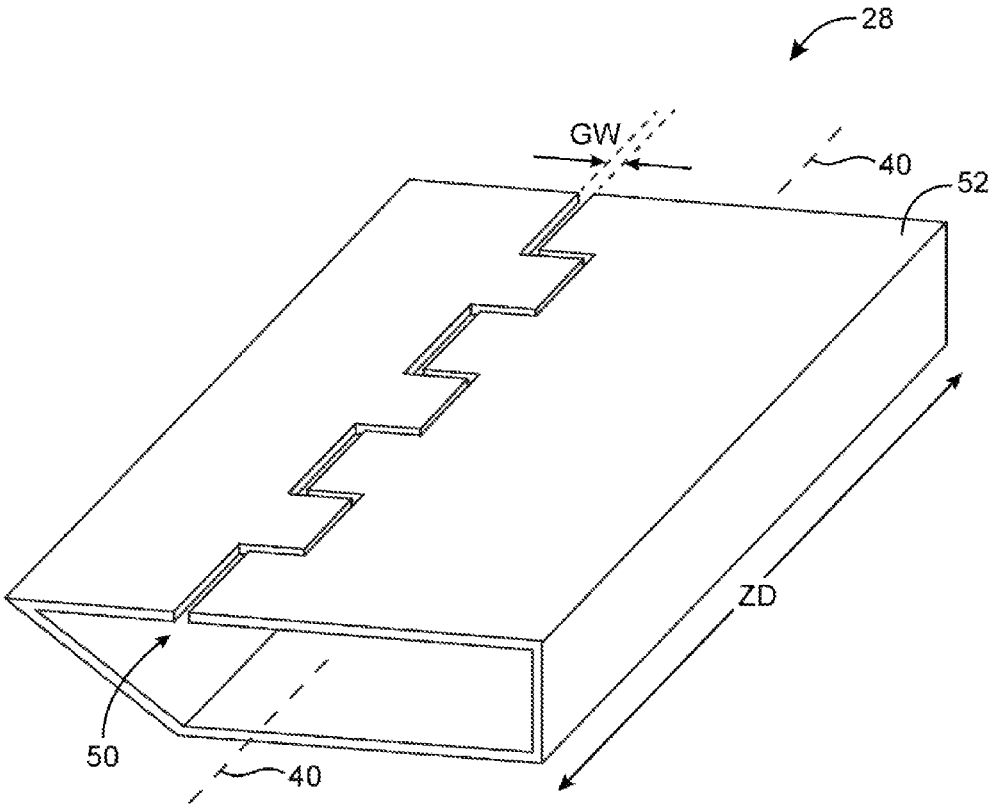
FIG. 20 is a perspective view of an illustrative distributed loop antenna resonating element having a meandering gap that increases gap capacitance in a sheet of conductor wrapped around a longitudinal axis of the distributed loop antenna resonating element in accordance with an embodiment of the present invention.

If desired, gap 50 may be provided with a meandering path shape, as shown in FIG. 20. The use of a meandering path may increase the total length of the gap and thereby increase the capacitance associated with the gap. For example, if the use of a meandering path shape of the type shown in FIG. 20 or other suitable meandering path shape doubles the total length of the gap (without changing the gap width GW), the capacitance can be doubled without increasing dimension ZD. Reductions in gap width GW may also be used to obtain desired increases in gap capacitance.

Figure 21:
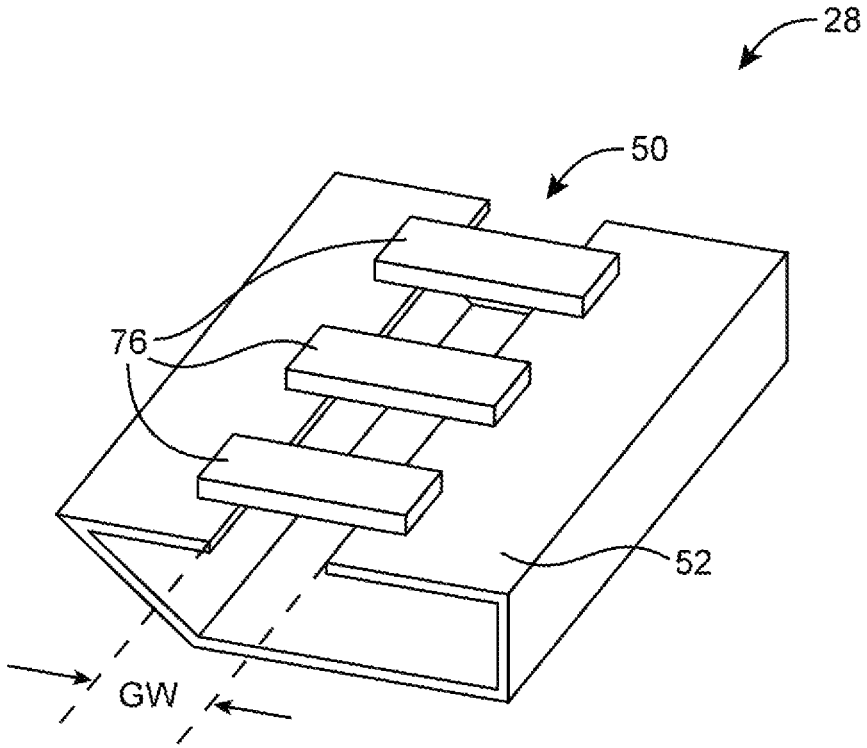
FIG. 21 is a perspective view of an illustrative distributed loop antenna resonating element having electrical components that bridge a gap in the distributed loop resonating element in accordance with an embodiment of the present invention.

FIG. 21 shows how gap capacitance can be configured using electrical components 76. Gap 50 may have a built-in capacitance due to its shape (i.e., whether meandering or straight) and size (e.g., gap width GW). In addition to the capacitance due to the layout of gap 50, the capacitance that is interposed within the loop formed by structures 52 may be affected by the capacitance of electrical components 76 that bridge gap 50. Electrical components 76 may be capacitors or components that exhibit a capacitance. Electrical components 76 may be, for example, surface mount technology (SMT) components that are attached to the conductive material of conductive structures 52 using solder. Electronic components 76 may include integrated circuits, one or more components such as capacitors, resistors, inductors, etc. that are packaged within a common SMT package, radio-frequency filter components, or other suitable circuit components.

If desired, components such as one or more of electronic components 76 or other components associated with distributed loop antenna 28 may be implemented using tunable components. Tunable components may be controlled in real time using control circuitry in device 10 (e.g., to produce desired amounts of capacitance). This allows device 10 to tune the frequency response of distributed loop antenna 28. Device 10 may, for example, tune antenna 28 when it is desired to cover additional frequency bands of interest (e.g., when switching from one type of wireless communications mode to another, when device 10 is moved into a new geographical region that uses a different set of wireless communications bands, etc.).

Figure 22:
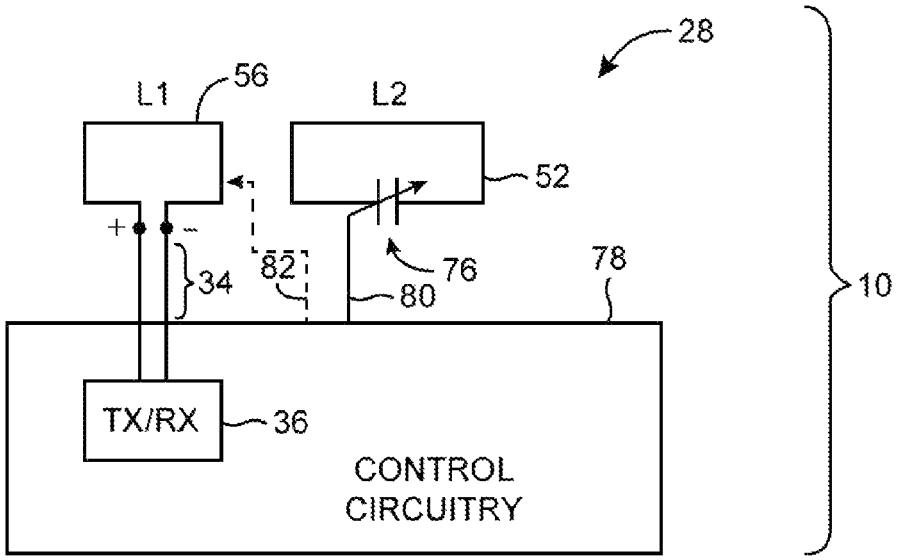
FIG. 22 is a diagram showing how a distributed loop antenna such as an indirectly fed distributed loop antenna may be provided with tunable circuitry such as a tunable capacitor to tune the distributed loop antenna in accordance with an embodiment of the present invention.

FIG. 22 shows how distributed loop antenna 28 may have a tunable component such a tunable capacitor 76 (e.g., a varactor). Tunable capacitor 76 may be implemented using an SMT component (e.g., an SMT varactor) that is controlled by control signal on path 80 from control circuitry 78. Control circuitry 78 may include one or more processors such as microprocessors, microcontrollers, controllers in baseband processor integrated circuits, controllers that are part of digital signal processors, control circuitry that is part of application-specific integrated circuits, or other suitable storage and processing circuitry. The control circuitry in device 10 may adjust tunable capacitor 76 to adjust the frequency response of distributed loop antenna 28. Feed antenna structure 56 in antenna 28 may also contain tunable components that are tuned by control signals from control circuitry 78, as illustrated by control signal path 82 in FIG. 22.

Figure 23:
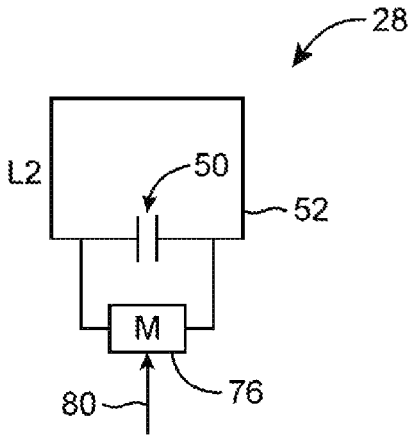
FIG. 23 is a diagram showing how a distributed loop antenna may be provided with tunable circuitry such as a tunable circuit with a parallel capacitor to tune the distributed loop antenna in accordance with an embodiment of the present invention.

FIG. 23 is a diagram showing how antenna 28 may have tunable components 76 that are incorporated into distributed loop antenna structure 52 in parallel with the capacitance formed by gap 50 (as an example). Tunable components 76 may include tunable capacitors, tunable resistors, tunable inductors, tunable filters, tunable integrated circuits, tunable filters, circuits that are tuned by adjusting switches, circuits that are tuned by adjusting multiple tunable components, or other tuning circuitry. Tunable components 76 may be incorporated into antenna feed structures L1 and/or antenna resonating element structures L2 in distributed loop antenna 28 and may be used in tuning impedance matching between radio-frequency structures.

Electronic device 10 may contain one distributed loop antenna 28, two or more distributed loop antennas 28, or one or more distributed loop antennas 28 in an array with one or more antennas of other types, or other suitable antennas. The conductive antenna structures of distributed loop antenna 28 may be oriented with respect to other antennas in device 10 so that isolation between antenna 28 and the other antennas in device 10 is maximized (i.e., so that coupling between antenna 28 and one or more additional antennas in device 10 is minimized).

Figure 24:
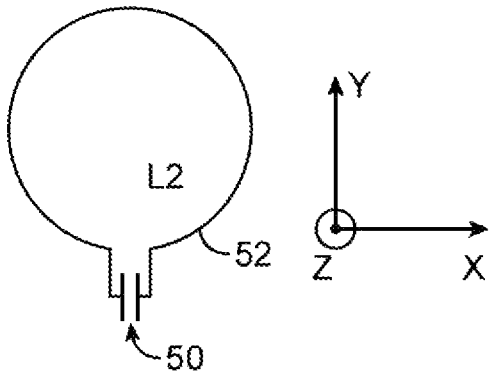
FIG. 24 is a diagram showing how a loop structure for a distributed loop antenna resonating element may be oriented with respect to an X-Y-Z coordinate system in accordance with an embodiment of the present invention.

FIG. 24 is a schematic diagram of an illustrative loop antenna resonating element L2 showing how the loop antenna resonating element may be oriented with respect to an X-Y-Z coordinate system.

Figure 25:
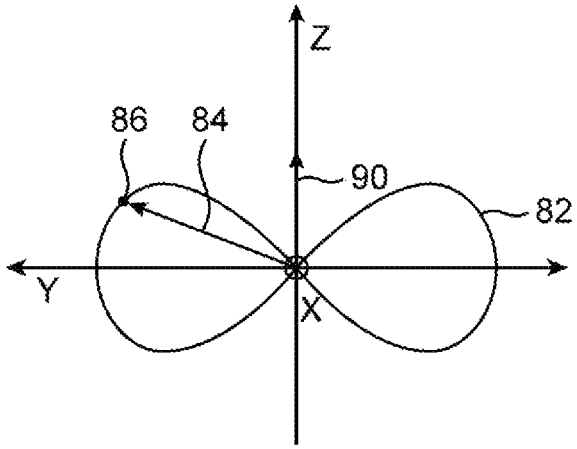
FIG. 25 is a graph of an illustrative radiation pattern that may be associated with a loop antenna of the type shown in FIG. 24 in accordance with an embodiment of the present invention.

FIG. 25 is a graph showing an illustrative radiation pattern (curve 82) for the loop antenna resonating element L2 of FIG. 24. Curve 82 corresponds to a typical far field radiation pattern and is also indicative of near field performance. The points on curve 82 are associated with antenna performance as a function of angular orientation and can therefore be used to determine where antenna coupling with nearby antennas is minimized. As an example, the loop antenna has a radiation strength given by point 86 in direction 84, whereas antenna resonating element structure L2 exhibits a minimum (null) in direction 90. By locating additional antennas in device 10 so that they lie along null (longitudinal) axis Z of loop antenna resonating element structure L2, coupling between the additional antennas and loop antenna resonating element structure 28 may be minimized.

Figure 26:
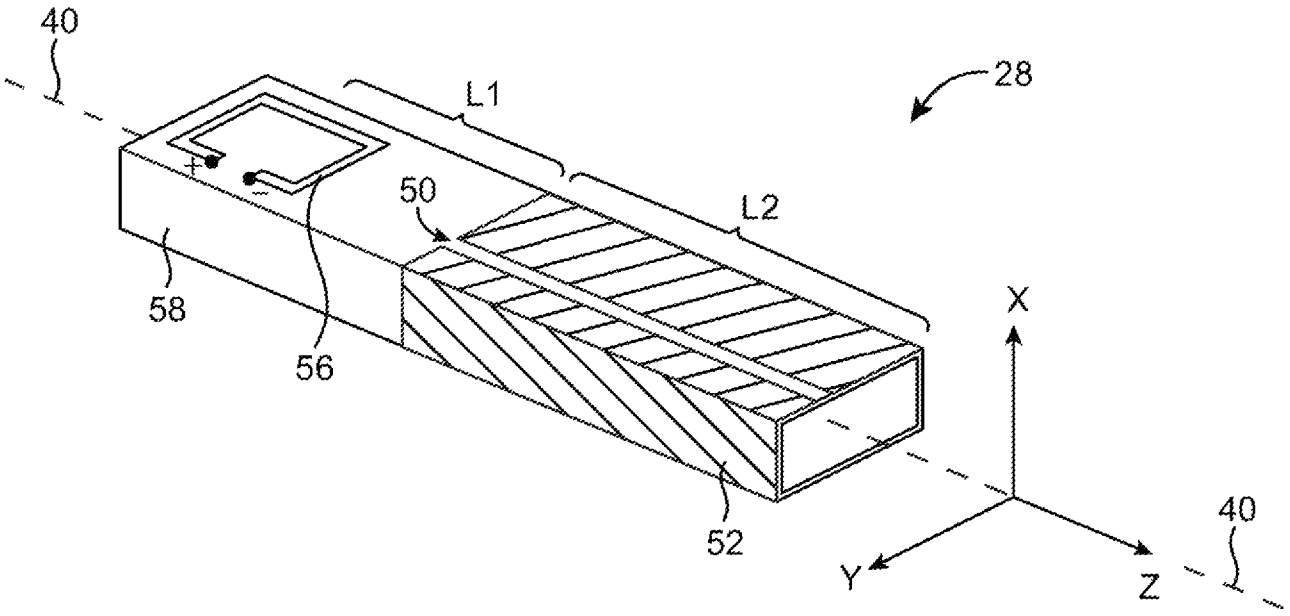
FIG. 26 is a perspective view of an illustrative indirectly fed distributed loop antenna formed from metal traces on a dielectric carrier showing how the loop structure of the antenna may be oriented with respect to an X-Y-Z coordinate system in accordance with an embodiment of the present invention.

FIG. 26 is a perspective view of an illustrative distributed loop antenna showing how loop antenna resonating element L2 may be oriented relative to an X-Y-Z coordinate system of the type shown in FIGS. 24 and 25. As shown in FIG. 26, longitudinal axis 40 of distributed loop antenna resonating element L2 may be oriented along the "Z" axis (i.e., the Z axis may serve as the longitudinal axis of the distributed loop antenna). The longitudinal Z axis of distributed loop antenna 28 of FIG. 26 represents a null position along which additional antennas may be located to minimize antenna-to-antenna coupling. In the configuration of FIG. 26, antenna feed structure L1 is formed from a loop that lies in a plane that is perpendicular to the plane containing the "loop" of antenna resonating element L2. If desired, other types of feed configurations may be used (e.g., arrangements in which resonating element L2 is directly fed, arrangements in which element L1 is oriented at different angles with respect to element L2, etc.). The feeding configuration of FIG. 26 is merely illustrative.

Figure 27:
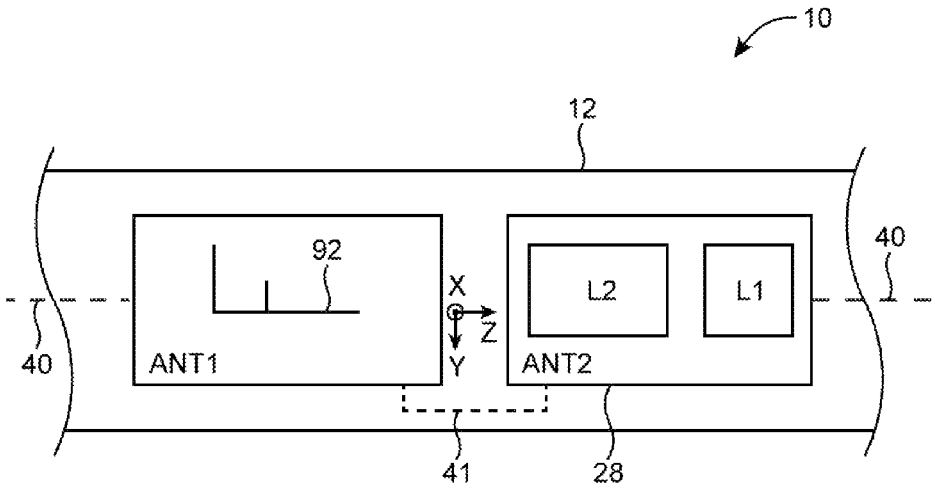
FIG. 27 is a diagram showing how an antenna such as an inverted-F antenna or other antenna may be isolated from a distributed loop antenna by locating the antenna along the longitudinal axis of the distributed loop antenna in accordance with an embodiment of the present invention.

FIG. 27 is a top view of a portion of housing 12 of device 10 in which two antennas have been mounted. In the example of FIG. 27, first antenna ANT 1 is shown as having an inverted-F antenna resonating element RE, but may, in general, be formed using any suitable type of antenna structure). Second antenna ANT2 is shown as being formed from a distributed loop antenna (antenna 28) having a loop antenna resonating element L2 and an antenna feed structure L1.

Figure 28:
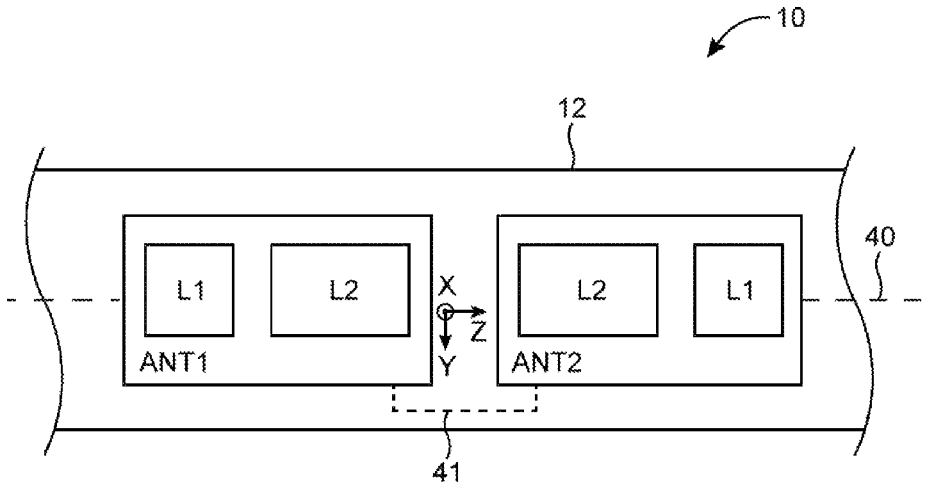
FIG. 28 is a diagram showing how a pair of distributed loop antennas can be isolated from each other by locating each distributed loop antenna along the longitudinal axis of the other distributed loop antenna in accordance with an embodiment of the present invention.

FIG. 28 is a top view of a portion of housing 12 in a device (device 10) in which both antennas (ANT1 and ANT2) have been implemented using a distributed loop antenna design.

Loop antenna element L2 of antenna ANT1 in the configuration of FIG. 27 and loop antenna elements L2 of antennas ANT1 and ANT2 in the configuration of FIG. 28 may be may be oriented so that their longitudinal axes (along axis Z) are pointed towards the other antenna in the array. In this way, ANT1 of FIG. 27 lies along the null axis of antenna ANT2. In FIG. 28, ANT1 lies along the null axis of antenna ANT2 and antenna ANT2 lies along the null axis of antenna ANT1. Configurations such as these may help to minimize near field electromagnetic coupling between antennas.

Antennas that are mounted along a common axis in edge portion 26 of housing 12 such as common longitudinal axis 40 in FIGS. 27 and 28 also have the potential to experience coupling through common ground plane currents. Common ground plane structures such as conductive portions of housing 12 or other conductive structures may form common ground paths such as ground paths 41 of FIGS. 27 and 28. When conductive housing structures that serve as antenna ground or other ground plane structures are shared by the antennas in the array, a first antenna in the array may induce current (e.g., current in a common ground path 41) that has the potential to couple into a second antenna in the array.

Due to presence of common ground path 41 in the examples of FIGS. 27 and 28, there is therefore the potential for induced ground current to lead to radio-frequency signal coupling between antennas ANT1 and ANT2.

As shown in FIGS. 27 and 28, ground path 41 extends parallel to shared axis 40 and dimension Z (i.e., the axis along which each of the antennas in the array is located). Loop currents in each distributed loop antenna tend to circulate in the X-Y plane, perpendicular to shared axis 40 and dimension Z. Because the currents in the loop antenna resonating elements do not tend to run parallel to common ground path 41, antenna-to-antenna coupling in the array via shared ground currents tends to be minimized. The use of one distributed loop antenna (e.g., antenna ANT2 of the antenna array of FIG. 27) or two or more distributed loop antennas (e.g., antennas ANT1 and ANT2 in the antenna array of FIG. 28) in an antenna array in device 10 may therefore help reduce common ground plane coupling and therefore may help each antenna operate relatively independently. For example, antennas ANT1 and ANT2 may be used in a multiple antenna setup such as an IEEE 802.11(n) setup to receive independent streams of wireless data. In this type of multiple-antenna arrangement, enhancing isolation between antennas ANT1 and ANT2 may improve overall data throughput.

The foregoing is merely illustrative of the principles of this invention and various modifications can be made by those skilled in the art without departing from the scope and spirit of the invention.

What is claimed is:

1. A loop antenna, comprising:

a loop antenna resonating element formed from a sheet of conductive material that is wrapped around an axis to form a conductive loop; and an antenna feed structure that is directly fed and that is configured to indirectly feed the loop antenna resonating element.

2. The loop antenna defined in claim 1 wherein the antenna feed structure comprises a loop-shaped structure.

3. The loop antenna defined in claim 1 further comprising:

a dielectric carrier on which the sheet of conductive material is formed.

4. The loop antenna defined in claim 1 wherein the sheet of conductive material forms a loop with a gap.

5. A loop antenna, comprising:

a loop antenna resonating element formed from a sheet of conductive material that is wrapped around an axis to form a conductive loop;

dielectric carrier on which the sheet of conductive material is formed; and an antenna feed structure on the dielectric carrier.

6. The loop antenna defined in claim 5 wherein the antenna feed structure is directly fed and is configured to indirectly feed the loop antenna resonating element.

7. The loop antenna defined in claim 6 wherein the antenna feed structure comprises a loop-shaped structure.

8. The loop antenna defined in claim 7 wherein the axis comprises a longitudinal axis associated with the loop antenna resonating element and wherein the loop-shaped structure comprise a loop of conductive material that lies in a plane perpendicular to the longitudinal axis.

9. A loop antenna, comprising:

a loop antenna resonating element formed from a sheet of conductive material that is wrapped around an axis to form a conductive loop, wherein the sheet of conductive material forms a loop with a gap and wherein the gap is configured to form a meandering path across the sheet of conductive material.

10. An electronic device, comprising:

a housing; and at least first and second antennas mounted in the housing, wherein at least the first antenna comprises a loop antenna having a longitudinal axis, wherein the loop antenna comprises a sheet of conductive material that extends around the longitudinal axis, wherein the second antenna lies along the longitudinal axis, wherein the sheet of conductive material is spanned by a gap that extends along the longitudinal axis, wherein the first antenna comprises an antenna feed structure, wherein the antenna feed structure is directly fed by a transmission line, wherein the sheet of conductive material is configured to form a loop antenna resonating element for the first antenna, and wherein the antenna feed structure is configured to indirectly feed the loop antenna resonating element.

11. The electronic device defined in claim 10 wherein the second antenna comprises an indirectly fed loop antenna.

12. An electronic device, comprising:

a housing; and at least first and second antennas mounted in the housing, wherein at least the first antenna comprises a loop antenna having a longitudinal axis, wherein the loop antenna comprises a sheet of conductive material that extends around the longitudinal axis, wherein the second antenna lies along the longitudinal axis, wherein the sheet of conductive material is spanned by a gap that extends along the longitudinal axis, wherein the housing includes conductive structures that at least partly define an interior region in the electronic device in which the first antenna is mounted, and wherein the gap lies along an exterior surface of the electronic device.

13. An antenna, comprising:

a dielectric carrier;

a loop antenna resonating element having a longitudinal axis, wherein the loop antenna resonating element comprises a sheet of conductive material that surrounds the dielectric carrier and extends around the longitudinal axis; and an antenna feed structure, wherein the loop antenna resonating element is indirectly fed by the antenna feed structure.

14. The antenna defined in claim 13 wherein the antenna feed structure comprises a loop of conductive material on the dielectric carrier that forms a loop antenna feed structure.

15. The antenna defined in claim 14 further comprising at least some metal on the dielectric carrier that is shorted between the loop antenna feed structure and the sheet of conductive material that forms the loop antenna resonating element.

16. The antenna defined in claim 15 wherein the loop antenna resonating element is configured to resonate in a first band and a second band and wherein the antenna feed structure is configured to resonate in the second band.

17. The antenna defined in claim 16 wherein the first band comprises a 2.4 GHz band and wherein the second band comprises a 5 GHz band.

* * * * *

UNITED STATES PATENT AND TRADEMARK OFFICE

CERTIFICATE OF CORRECTION

PATENT NO. : 8,963,794 B2
APPLICATION NO. : 13/216073
DATED : February 24, 2015
INVENTOR(S) : Jiang Zhu et al.

It is certified that error appears in the above-identified patent and that said Letters Patent is hereby corrected as shown below:

In the Claims

In claim 8, column 14, line 48, delete "structure comprise a loop of conductive material" and insert -- structure comprises a loop of conductive material --.

Signed and Sealed this
Twenty-first Day of July, 2015

Michelle K. Lee

Michelle K. Lee
*Director of the United States Patent and Trademark Office*